United States Patent [19]

Kempel

[11] Patent Number: 4,489,459

[45] Date of Patent: Dec. 25, 1984

[54] ADJUSTABLE HINGE CONSTRUCTION INCLUDING SPRING CLIPS FOR PREFAB DOOR AND JAMB ASSEMBLIES

[75] Inventor: John J. Kempel, West Branch, Mich.

[73] Assignee: Garland Manufacturing Co., West Branch, Mich.

[21] Appl. No.: 515,624

[22] Filed: Jul. 20, 1983

[51] Int. Cl.[3] ..... E05D 7/04

[52] U.S. Cl. ..... 16/248; 16/382; 16/DIG. 39; 16/DIG. 40; 49/399

[58] Field of Search ..... 16/237, 242, 243, 248, 16/252, 382, DIG. 39, DIG. 40; 49/399, 400

[56] References Cited

U.S. PATENT DOCUMENTS 2,620,508 12/1952 Goulooze ..... 16/248
2,836,269 5/1958 Anderson ..... 16/242 X
3,690,037 9/1972 Kempel ..... 16/242 X
4,106,238 8/1978 Bonello ..... 49/399 X

*Primary Examiner*—Fred A. Silverberg
*Attorney, Agent, or Firm*—Harness, Dickey & Pierce

[57] ABSTRACT

A preformed door, preferably of metal, with a frame of wood in which a floating hinge connection is provided allowing the door to be adjusted relative to the frame by way of a hinge securing floating clamping plate disposed within a channel formed in the hinge stile member of the door. The clamping plate is retained by clips frictionally secured between sidewalls of the hinge stile member to prevent the plate from falling away from the channel, while a pair of stops embossed in the channel wall limit sliding movement of the clamping plate within predefined limits.

15 Claims, 10 Drawing Figures

ADJUSTABLE HINGE CONSTRUCTION INCLUDING SPRING CLIPS FOR PREFAB DOOR AND JAMB ASSEMBLIES

BACKGROUND OF THE INVENTION

1. Field of the Invention

The invention pertains generally to precut and fitted door and frame assemblies, and more particularly to an adjustable hinge construction in which the hinge stile is formed of an extruded metal channel with clamping plate slidably disposed within the channel for adjustably receiving the hinge mounting screws or fasteners.

2. Description of the Prior Art

Precut and fitted coors and frame assemblies are becoming increasingly popular with builders because of the labor saving advantages they offer. Although good quality control during factory production has eliminated many clearance problems, prefabricated doors still require close tolerance dimensioning, particularly when the doors are hung on hinges at the building site. For example, it is often necessary to adjust or slightly re-position the doors on its hinges so that the door will properly fit within the door jamb without unslightly and energy wasteful air gaps.

The problem of prefabricated door alignment is generally addressed in U.S. Pat. No. 3,690,037 entitled "Prefabricated Door and Frame Assembly" which issued to the present inventor on Sept. 12, 1972. The door and frame assembly disclosed in said patent comprised a floating hinge connection which allowed the door to be adjusted relative to the door jamb as and when necessary. More specifically, the floating hinge connection included a floating plate located at the hinge position fastened to the hinge stile by rivets so that it had lateral freedom of movement. The floating connection was obtained by oversized holes for the rivet pins so that side to side and up and down movement was possible.

While the above described door and frame assembly is generally satisfactory, there remains a need for improvement. For example, in the prior art assembly the heads of the floating hinge rivets are exposed along the edge of the finished door, which is considered by some to be unsightly. Furthermore, it is desirable to reduce manufacturing costs and assembly times attributable to the floating hinge rivets, hence elimination of these rivets would greatly improve the prefabricated door and frame assembly.

SUMMARY OF THE INVENTION

In accordance with the present invention an improved assembly for adjustably securing a door to its hinge implementing a floating hinge connection is provided. The hinge is secured to the door using conventional fasteners such as screws, for example, which are secured into a floating plate located at the hinge position. The hinge arrangement enables the door to be hung with relative ease and with every assurance that it will swing true, or as otherwise desired. By means of the floating plate located at the hinge position adjustments of the door are easily obtained. More specifically, the hinge stile of the door includes sidewalls and end wall. The end wall defines an enlarged aperture registrable with the hinge fastener screws and having a sufficiently enlarged cross sectional area to permit the fastening screws to translate with respect to the stile. The stile formed with a channel in the end wall in which a floating clamping plate is slidably disposed. The clamping plate includes threaded holes for receiving hinge fastening screws. The clamping plate is retained by means of a spring clip frictionally secured between the sidewalls of the hinge stile so as to hold the clamping plate generally against the end wall of the stile. Stop means, preferably embossed ribs, in the bottom of the channel in spaced relation to the clamping plate serve to limit sliding movement of the clamping plate within the channel.

The foregoing construction thus has the advantage of eliminating the floating hinge rivets of prior art door and frame assemblies with the attendant reduction in material costs and labor. These and other objects and advantages attained in the practice of this invention will be better appreciated in a reading of the detailed description of the invention with reference to the accompanying drawings.

DESCRIPTION OF THE PREFERRED EMBODIMENT

The door and frame assembly 12 includes a metal clad door 14, a wooden frame 15 precut and sized to fit about the door with a known amount of side clearance, a threshold member 16 for under the door, and a floating hinge connection described more fully herein to hang the door on the frame.

Figure 1:
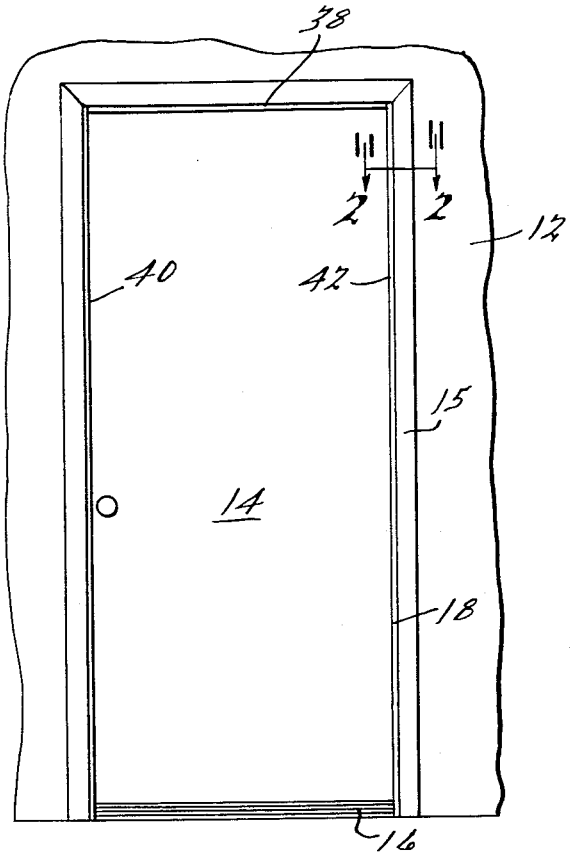
FIG. 1 is a front elevational view of a door including all of the features of the present invention.
Figure 2:
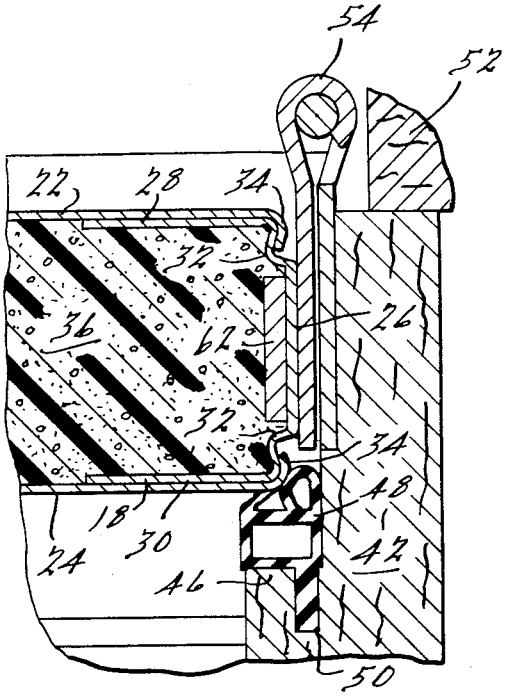
FIG. 2 is an enlarged cross sectional view through the hinge stile and hinge jamb taken along the line 2—2 of FIG. 1.

The door 12 includes a hinge stile 18 of channel section, as shown in FIG. 2, with metal facing panels 22 and 24 to provide the front and back sides of the door. Hinge stile 18 has an end wall 26 and sidewalls 28 and 30 thereby comprising a generally channel shaped member having u-shaped cross section. The sidewalls 28 and 30 each join with end wall 26 to define inset corners 32. Corners 32 receive turned edges 34 of the metal panels 22 and 24, for a more finished appearance and to secure the metal panels to the hinge stile. The door has a center section 36 of hard setting plastic foam, or the like, inserted or injected during the construction of the door or blown in afterwards.

The door frame 14 includes a header bar or rail 38 and side rails 40 and 42, which serve as the lock and hinge jambs, respectively. Rails 38, 40 and 42 are formed with suitable stops to provide a stop for the door within the frame. FIG. 2 illustrates stop 46 formed on the hinge jamb side rail 42 which is equipped with weather stripping member 48 which is secured in saw kerf 50. Suitable finished moulding 52 is provided about the edges of the frame, although shown in only a few of the drawing figures, and is normally, though not necessarily, provided on at least one side of the frame as a stop in locating the door and frame assembly in a respective opening in a wall.

Figure 4:
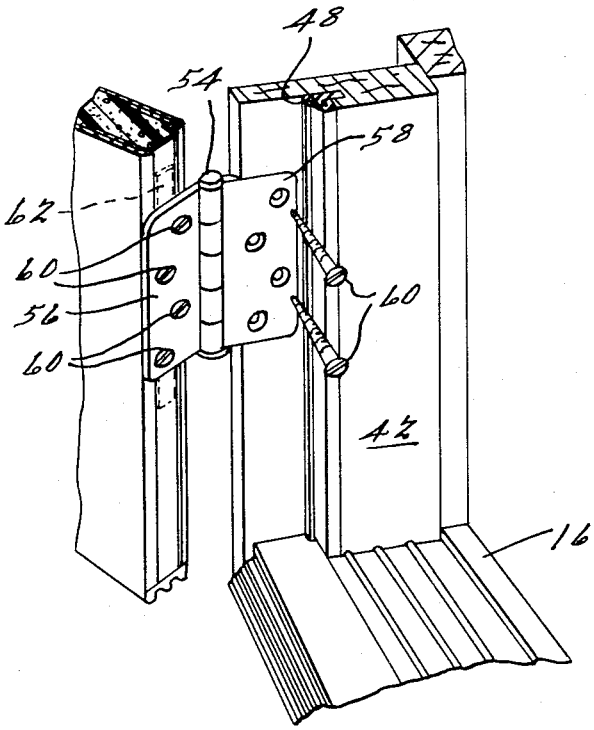
FIG. 4 is an enlarged perspective view and partially exploded view of the hinge side of the door frame, showing the adjustable hinge connection to an open door.

FIGS. 2 and 4 show details of the hinge 54 and its connection between the door frame and the door. For purposes of illustrating the invention a standard type hinge is shown with hinge leaves 56 and 58 for attachment, respectively, to door and frame parts as with screws 60. In practice, at least two hinges, and normally three hinges are employed to support the weight of the door. As shown in FIG. 4 hinge 54 is secured to the hinge jamb rail 42 in the conventional fashion, whereas hinge 54 is secured to the door 14 by means of a floating clamping plate 62, illustrated in phantom in FIG. 4.

Figure 3:
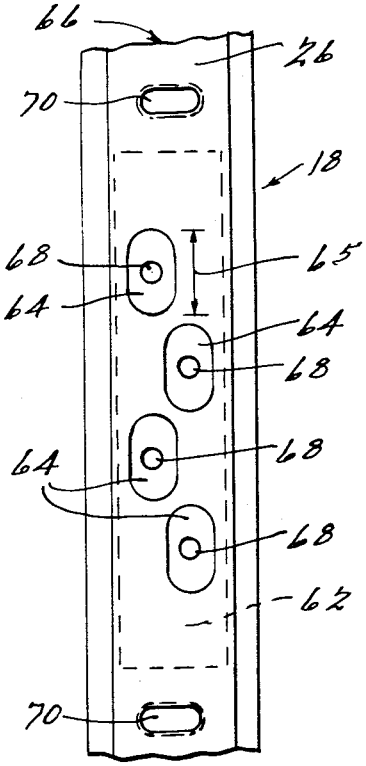
FIG. 3 is an enlarged side plan view of the floating hinge plate in the door.
Figure 5:
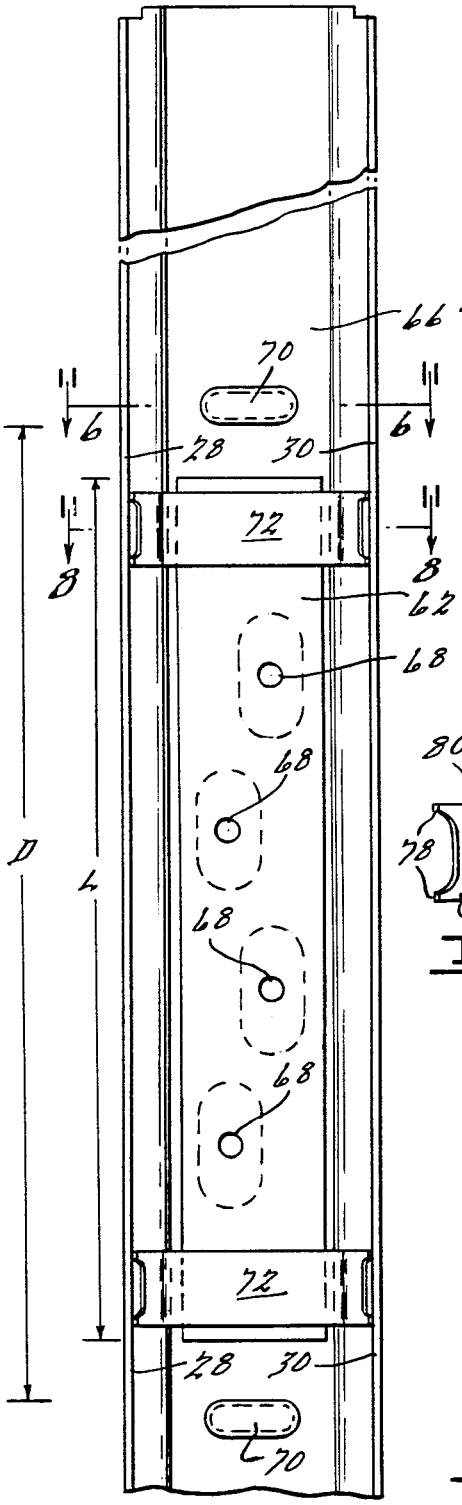
FIG. 5 is a fragmentary elevational view of the hinge stile in accordance with the present invention.
Figure 6:
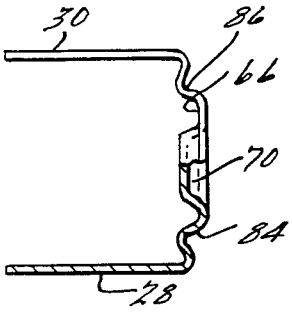
FIG. 6 is a cross sectional view of the hinge stile taken along the line 6—6 of FIG. 5.
Figure 9:
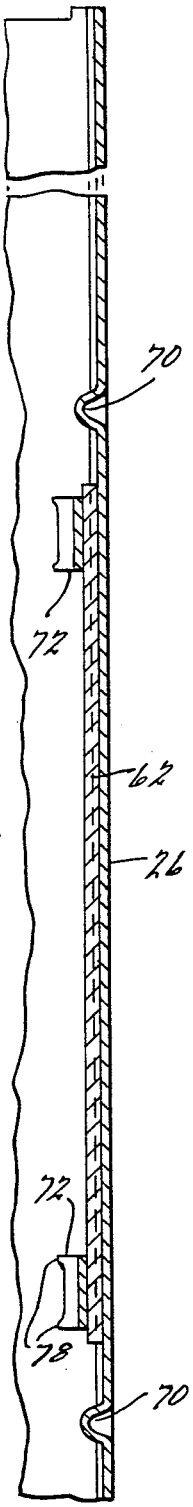
FIG. 9 is a longitudinal cross sectional view of the hinge stile taken along the line 9—9 of FIG. 5.
Figure 10:
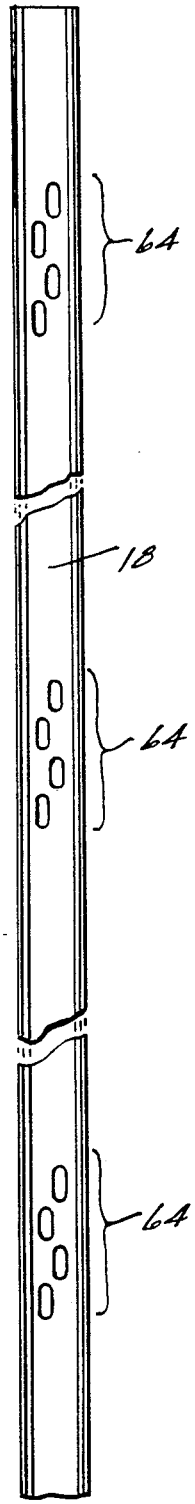
FIG. 10 is a fragmentary end elevational view of the hinge stile.

Having thus described the general construction of the door and frame assembly, the hinge stile and floating clamping plate will now be discussed in greater detail. With reference to FIG. 3 hinge stile 18 is shown as it might be seen by viewing the hinged edge of the door before it is hung. End wall 26 thereof includes a plurality of elongated slotted openings or apertures 64 which are arranged so as to register or align with hinge securing screws 60 when the door is in place ready to be hung. Apertures 64 have a lengthwise dimension 65 and are disposed so that this lengthwise dimension is generally aligned with the length of stile 18. The cross sectional area of apertures 64 is substantially greater than the cross sectional area of screw fasteners 60. FIG. 10 is a similar view of the hinge stile 18 showing the general location of the apertures 64 corresponding to the hinge locations of a typical three hinge door. For illustration purposes certain of the details shown in FIG. 3 have been omitted from FIG. 10. Referring now to FIGS. 5, 6 and 9, with continued reference to FIG. 3, end wall 26 is formed or extruded to define a channel 66. Channel 66 extends substantially the full length of hinge stile 18 with a lengthwise dimension generally aligned with the length of stile 18. Disposed within channel 66 for sliding movement therein is clamping plate 62 which was discussed briefly above. Clamping plate 62 includes a plurality of threaded holes 68 which are spaced apart so as to register with and receive the hinge securing screws 60. Clamping plate 62 is disposed within channel 66 so that threaded holes 68 are aligned behind apertures 64, thereby permitting translational movement of screw fasteners 60 with respect to hinge stile 18. Since apertures 64 are of greater cross sectional area than the screw fasteners 60, a considerable translational freedom of movement is permitted. The fact that apertures 64 are alongated in a lengthwise direction along stile 18 permits greater up-down adjustment of the door than was heretofore possible in the prior art.

Hinge stile 18 further includes stops 70 which are formed or embossed in channel 66 in spaced relation to clamping plate 62 so as to limit sliding movement of the clamping plate within channel 66. Stops 70 are best seen in FIGS. 5, 6 and 9. Clamping plate 62 is of a predetermined length L whereas stops 70 are spaced apart a distance D, the distance D being greater than length L. Stops 70 thereby serve to retain clamping plate 62 in place by limiting the sliding movement thereof.

To further retain clamping plate 62 in place within channel 66 a clip means is provided. Although a wide variety of different clip configurations are possible within the spirit of the invention, the presently preferred clip configuration comprises a pair of metal spring clips 72 which are frictionally secured between sidewalls 28 and 30, as best seen in FIG. 5. Preferably cips 72 are located generally adjacent clamping plate 62 so as to prevent clamping plate 62 from falling outwardly from channel 66, and spaced apart sufficiently so as not to obstruct apertures 64.

Figure 7:
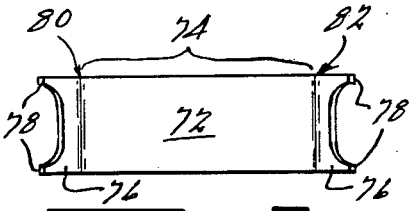
FIG. 7 is a top view of the retainer clip.
Figure 8:
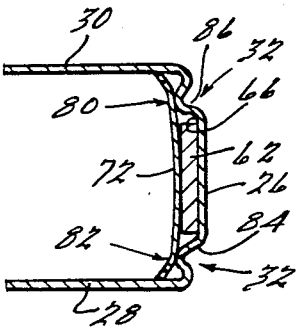
FIG. 8 is a cross sectional view of the hinge stile taken along the line 8—8 of FIG. 5.

In the presently preferred embodiment each clip 72 is constructed as shown in FIGS. 7 and 8 of a spring steel material. Clip 72 includes a substantially flat central portion 74 which, in use, serves to retain or prevent clamping plate 66 from falling away from channel 66. Clip 72 further includes a pair of bent end portions 76, each end portion having a pair of teeth 78 for biting engagement with and between the sidewalls 28 and 30 of hinge stile 18. Preferably bent portions 76 are formed by bending clip 72 as at locations 80 and 82 which, when the clip is in place, generally overlie the channel defining sidewalls 84 and 86 of channel 66. Generally the running length of the clip as measured from end to end is greater than the distance between sidewalls 28 and 30. Thus clip 72 is under compression when disposed between the sidewalls thereby rendering clip 72 in a tight frictional fit between sidewalls 28 and 30. As best shown in FIG. 8 clip 72 is bent as at positions 80 and 82 to define end portions 76, and positions 80 and 82 are generally adjacent the channel forming sidewalls 84 and 86. This has the advantage of accurately confining clamping plate 62 within channel 66 without inhibiting its ability to slide within the channel. It is also noted that in the preferred embodiment the channel defining sidewalls 84 and 86 also define the in turned corners 32 used to secure the front and back panels 22 and 24 to the hinge stile.

While it will be apparent that the preferred embodiments of the invention disclosed are well calculated to fulfill the objects above stated, it will be appreciated that the invention is susceptible to modification, variation and change without departing from the proper scope or fair meaning of the invention.

What is claimed is:

1. An assembly for adjustably securing a door to a hinge means having at least one fastener means adapted for securing said hinge means to said door comprising:

hinge stile means having side walls and an end wall, said end wall defining an enlarged aperture registerable with said fastener means, said enlarged aperture having substantially greater cross sectional area than said fastener means thereby permitting translational movement of said fastener means with respect to said stile means, means defining a channel in said end wall, clamping plate means slidably disposed within said channel having a fastener receiving aperture of engaging with said fastener means, and means for retaining said clamping plate means including clip means frictionally secured between said side walls for holding said clamping plate generally against said end wall and stop means disposed in said channel in spaced relation to said clamping plate means for limiting sliding movement of said clamping plate means within said channel.

2. The assembly of claim 1 wherein said hinge stile means comprises generally channel-shaped means.

3. The assembly of claim 1 wherein each side wall joins said end wall to define inset corner means and said door includes front and back panels having inturned edges received by said inset corner means.

4. The assembly of claim 1 wherein said end wall defines a plurality of enlarged apertures.

5. The assembly of claim 1 wherein said enlarged aperture comprises an elongated slotted opening.

6. The assembly of claim 5 wherein said elongated slotted opening is disposed with its lengthwise dimension generally aligned with the length of said stile means.

7. The assembly of claim 1 wherein said channel has a lengthwise dimension generally aligned with the length of said stile means.

8. The assembly of claim 1 wherein said channel extends substantially the full length of said stile means.

9. The assembly of claim 1 wherein said means defining a channel comprises an extruded formation.

10. The assembly of claim 1 wherein said fastener receiving apertures are internally threaded.

11. The assembly of claim 1 wherein said clip means comprises spring clip means.

12. The assembly of claim 1 wherein said clip means includes teeth means for biting engagement with said side walls.

13. The assembly of claim 1 wherein said clip means comprises spring means having bent end portions.

14. The assembly of claim 1 wherein said clip means has a running length greater than the distance between said side walls such that said clip means is under compression when disposed between said side walls.

15. The assembly of claim 1 wherein said stop means comprises embossed means disposed in the bottom of said channel.

* * * * *

UNITED STATES PATENT AND TRADEMARK OFFICE

CERTIFICATE OF CORRECTION

PATENT NO. : 4,489,459

DATED : December 25, 1984

INVENTOR(S) : John J. Kempel

It is certified that error appears in the above-identified patent and that said Letters Patent is hereby corrected as shown below:

Column 1, line 15, "coors" should be -- doors --

Column 1, line 24, "unslightly" should be -- unsightly --

Column 3, line 57, "alongated" should be -- elongated --

Column 4, line 8, "cips" should be -- clips --

Column 4, line 16, clamping plate "66" should be -- 62 --

Column 4, line 58, "of" should be -- for --

Signed and Sealed this

*Fifteenth* Day of *October 1985*

[SEAL]

*Attest:*

*Attesting Officer*

DONALD J. QUIGG

*Commissioner of Patents and Trademarks—Designate*